US011678428B2

(12) United States Patent
Raymond et al.

(10) Patent No.: US 11,678,428 B2
(45) Date of Patent: Jun. 13, 2023

(54) METHOD OF ASSEMBLING AN ELECTRODE

(71) Applicant: The ESAB Group Inc., Florence, SC (US)

(72) Inventors: Andrew Raymond, Lebanon, NH (US); Jeffrey S. Underhill, Piermont, NH (US)

(73) Assignee: THE ESAB GROUP, INC., North Bethesda, MD (US)

( * ) Notice: Subject to any disclaimer, the term of this patent is extended or adjusted under 35 U.S.C. 154(b) by 832 days.

(21) Appl. No.: 16/530,505

(22) Filed: Aug. 2, 2019

(65) Prior Publication Data

US 2021/0037636 A1 Feb. 4, 2021

(51) Int. Cl.
*H05H 1/34* (2006.01)

(52) U.S. Cl.
CPC ..... *H05H 1/34* (2013.01)

(58) Field of Classification Search
CPC ..... H05B 3/03; H05B 3/06; H05B 7/06–085; B23K 9/28–282; B23K 9/285; B23K 9/287; B23K 9/30; B23K 37/02; H05H 1/34–3423; H05H 1/38
See application file for complete search history.

(56) References Cited

U.S. PATENT DOCUMENTS 6,114,650 A * 7/2000 Marner ..... B23K 10/00
6,268,583 B1 * 7/2001 Yamaguchi ..... B23K 10/00 219/121.52
6,423,922 B1 7/2002 Nemchinsky
6,433,300 B1 8/2002 McBennett
6,452,130 B1 9/2002 Qian et al.
6,563,075 B1 5/2003 Severance, Jr. et al.
6,583,738 B2 * 6/2003 Yamaguchi ..... B23K 10/00
6,657,153 B2 12/2003 McBennett et al.
6,946,617 B2 9/2005 Brandt et al.
7,019,255 B2 3/2006 Brandt et al.
7,193,174 B2 3/2007 Brandt et al.
7,576,300 B2 8/2009 Giese
7,754,996 B2 7/2010 Brandt et al.
(Continued)

FOREIGN PATENT DOCUMENTS

EP 1765046 A1 3/2007
IT BO20130301 A1 * 6/2013
IT B020130302 A1 12/2014

OTHER PUBLICATIONS

Physics-Hypertextbook, Elasticity:, Jul. 4, 2016, pp. 1-10 (Year: 2016).*

(Continued)

*Primary Examiner* — Erin E Mcgrath
(74) *Attorney, Agent, or Firm* — Edell, Shapiro & Finnan, LLC

(57) ABSTRACT

A method of assembling an electrode by securing together an emitter of the electrode inside an emitter holder while at the same time securing together the emitter holder inside a distal end of a tubular body of the electrode. According to one implementation the securing together includes simultaneously applying a proximally directed force to the emitter and a distally directed force to the emitter holder to cause a bulging of the emitter inside the emitter holder and a bulging of the emitter holder inside the distal end of the tubular body.

16 Claims, 6 Drawing Sheets

(56) References Cited

U.S. PATENT DOCUMENTS

| | | | | |
|---|---|---|---|---|
| 8,035,055 | B2 | 10/2011 | Twarog et al. | |
| 8,101,882 | B2 | 1/2012 | Mather et al. | |
| 8,115,136 | B2 | 2/2012 | Mather et al. | |
| 8,541,712 | B2 | 9/2013 | Mather et al. | |
| 8,546,718 | B2 | 10/2013 | Mather et al. | |
| 8,633,422 | B2 | 1/2014 | Giese | |
| 8,656,577 | B2 | 2/2014 | Hussary et al. | |
| 8,680,426 | B2 | 3/2014 | Hussary et al. | |
| 8,933,364 | B2 | 1/2015 | Hussary et al. | |
| 9,462,671 | B2 | 10/2016 | Reinke et al. | |
| 9,492,883 | B2 | 11/2016 | Mather et al. | |
| 9,736,918 | B2 | 8/2017 | Mather et al. | |
| 2017/0080510 | A1 | 3/2017 | Centner et al. | |
| 2017/0080511 | A1 | 3/2017 | Jaeger et al. | |
| 2017/0080512 | A1 | 3/2017 | Centner et al. | |
| 2018/0354022 | A1* | 12/2018 | Ross | B23K 1/463 |

OTHER PUBLICATIONS

Notification of Transmittal of the International Search Report and the Written Opinion including International Search Report and Written Opinion for PCT/US2020/042983 dated Oct. 16, 2020, 12 pages.

* cited by examiner

METHOD OF ASSEMBLING AN ELECTRODE

TECHNICAL FIELD

The present disclosure relates to a method of assembling an electrode suitable for use in a plasma torch.

BACKGROUND

More cost and time efficient methods for assembling together the parts of a plasma torch electrode are needed.

SUMMARY

The present disclosure is directed towards methods of assembling a plasma torch electrode. According to one implementation a method includes securing together an emitter of the electrode inside an emitter holder while at the same time securing together the emitter holder inside a tubular body of the electrode. The securing together is accomplished by simultaneously applying a proximal directed force to the emitter and a distal directed force to the emitter holder to induce a bulging of the emitter inside the emitter holder to cause an external surface of the emitter to forcefully contact an internal surface of the emitter holder, and to induce a bulging of the emitter holder inside the distal end of the tubular body to cause an external surface of the emitter holder to forcefully contact an internal surface of the tubular body to produce a leak-tight seal and an electrical connection between the emitter holder and the tubular body. According to some implementations, the securing together is accomplished without soldering or fusing the emitter holder to the tubular body and without soldering or fusing the emitter to the emitter holder.

Each of the tubular body, emitter and emitter holder are respectively made of first, second and third materials that are different from one another. The first material may be, for example, copper or a copper alloy, the second material may be, for example, hafnium, tungsten, zirconium and their alloys, and the third material may be, for example, silver. In the assembly methods of the present application, when the proximal and distal directed forces are applied to cause a joining of the respective parts as discussed above, none of the first, second and third materials combine with one another to form an alloy of the materials. Instead, the first, second and third materials remain as they were prior to the electrode assembly process. Thus, when it is stated herein that the parts are secured together without "fusing", it is meant that the first, second and third materials do not melt together or otherwise combine to form another type of material.

The methods of assembling an electrode disclosed and contemplated herein reduce assembly times and manufacturing costs. These and other advantages and features will become evident in view of the drawings and detailed description.

DETAILED DESCRIPTION

Various implementations of assembling an electrode of a plasma torch are disclosed herein. Although the disclosure is directed to the securing together of an emitter, emitter holder and tubular body to form the electrode, it is appreciated that the electrode may have any of a variety of other parts.

Figure 1:
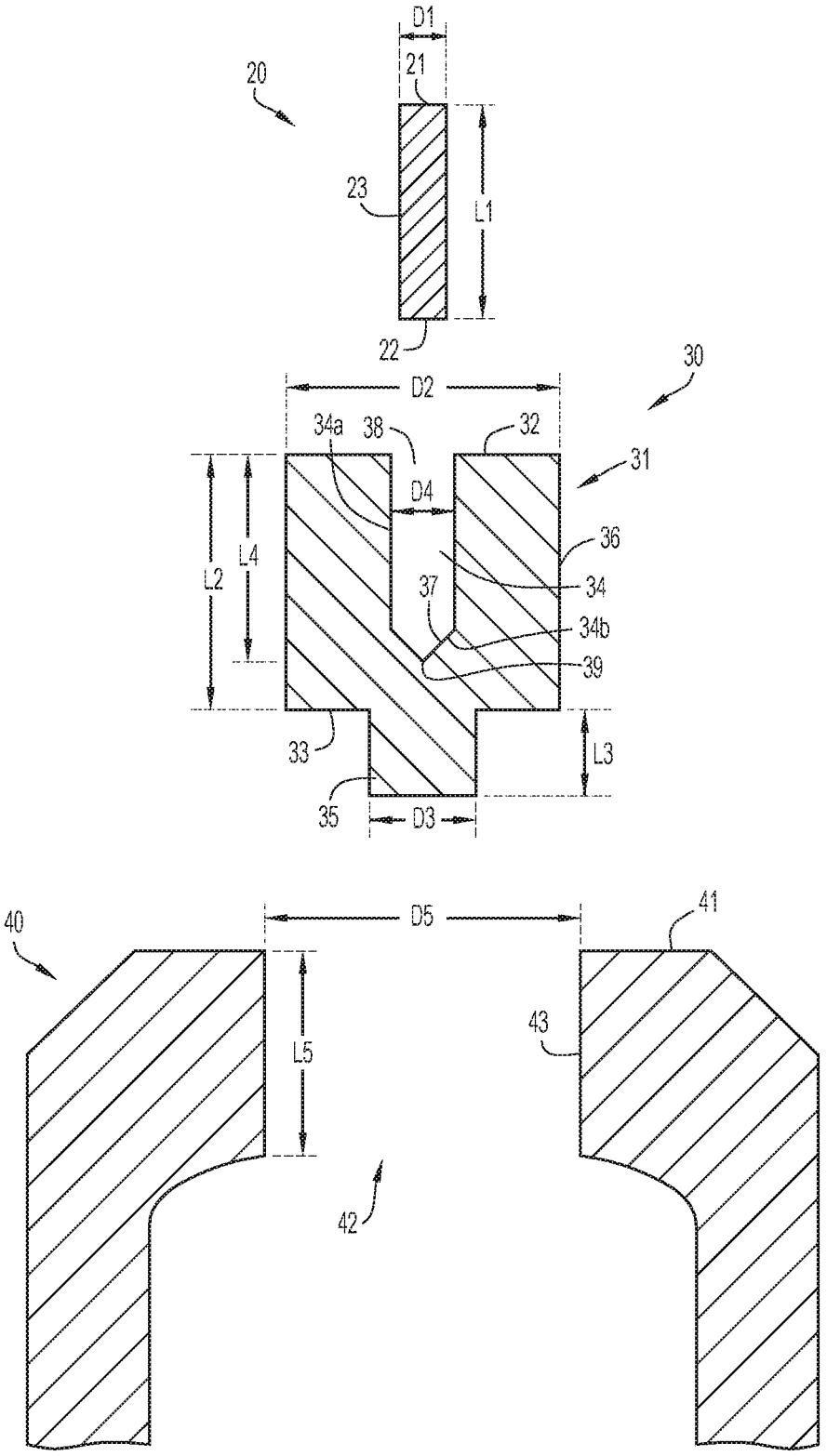
FIG. 1 is a cross-sectional side view of an emitter, emitter holder and tubular body of an electrode according to one implementation.

FIG. 1 shows cross-section side views of the three parts to be joined together to form a plasma torch electrode. The parts include an emitter 20, and emitter holder 30 and a tubular body 40. The methods disclosed herein are associated with securing the emitter 20 inside a cavity 34 of the emitter holder 30 while at the same time securing the emitter holder 30 inside a through opening 42 located in a distal end of the tubular body 40.

Figure 2:
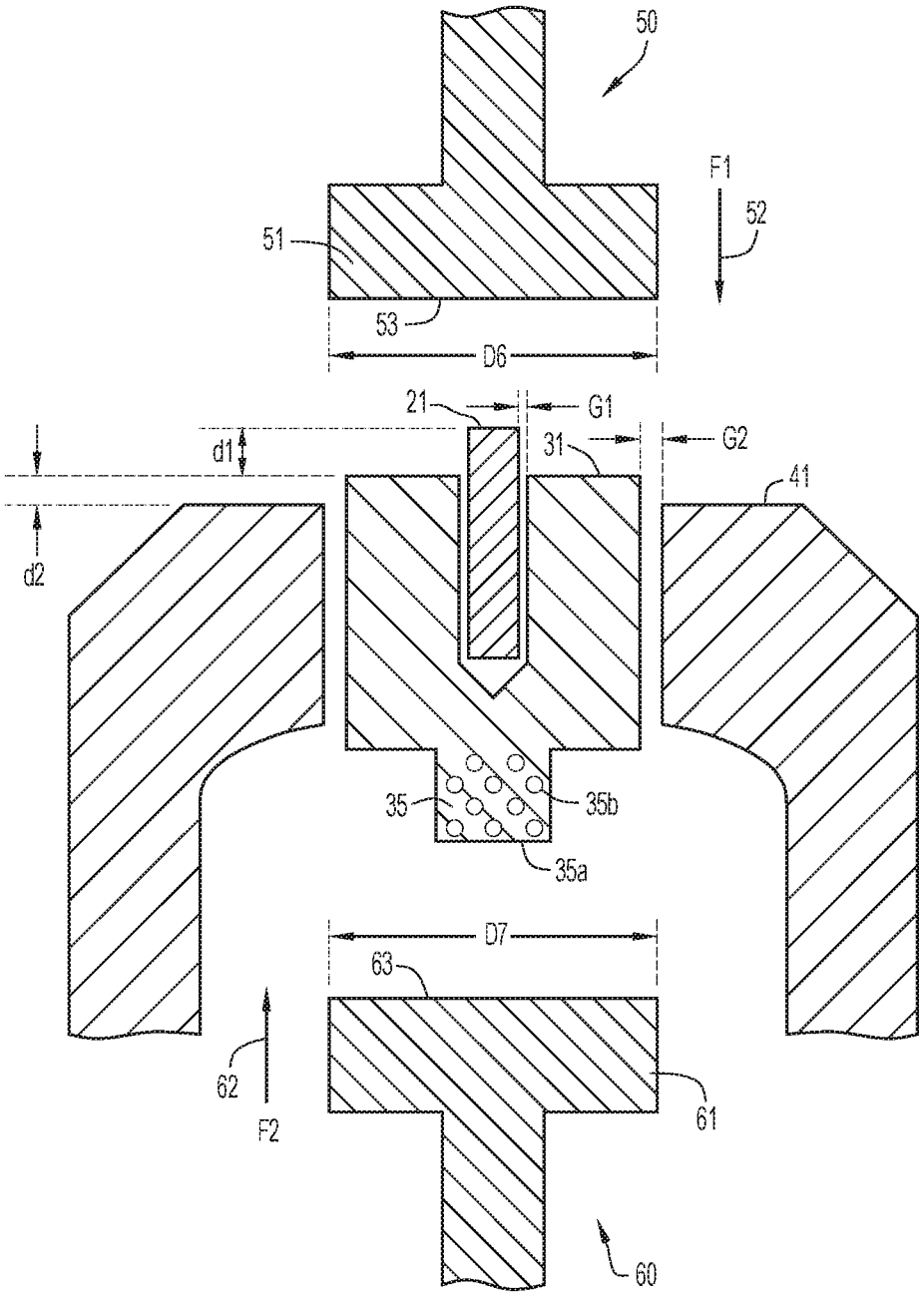
FIG. 2 is a cross-section side view of an arrangement of the emitter, emitter holder and tubular body of FIG. 1 in a pre-assembled state just prior to forces being applied to the parts to secure them together.

According to some implementations, the emitter 20 is a cylindrical body that includes a distal end 21, a proximal end 22 and a cylindrical external wall 23. In its original state, as shown in FIGS. 1 and 2, the emitter 20 has a diameter D1 and a length L1. As discussed above, the emitter 20 may be made of a variety of different materials, including, but not limited to, hafnium, tungsten, zirconium and their alloys.

According to some implementations, the emitter holder 30 includes an internal cavity 34 that has an open distal end 38 and a closed proximal end 39. According to some implementations, a distal end section 34*a* of the cavity is cylindrical, and a proximal end section 34*b* of the cavity is cone-shaped formed by a converging inner wall 37. According to some implementations, the emitter holder 30 includes a proximally protruding part 35 that is meant to reside inside a cavity 44 of the tubular body 40 before and after the electrode is assembled, the purpose of which is discussed below. The emitter holder 30 includes a cylindrical body 31 in which the cavity 34 resides. The cylindrical body 31 includes a distal end 32, proximal end 33 and an external cylindrical wall 36. When the emitter holder 30 is in its original state, as shown in FIGS. 1 and 2, the cylindrical body portion 31 has an external diameter D2 and a length L2 and the proximally protruding part 35 has a diameter D3 and a length L3. The internal cavity 34 of the emitter holder 30, in turn, has a diameter D4 greater than the diameter D1 of the emitter 20 and a length L4 less than the length L1 of the emitter 20 as best shown in FIG. 2. As discussed above, the emitter holder 30 is typically made of silver.

With continued reference to FIG. 1, the distal end section of the tubular body 40 includes a through opening 42 bound by a cylindrical wall 43 located at a distal end of the tubular body. In the tubular body's original state, as shown in FIGS. 1 and 2, the through opening 42 communicates with an inner chamber 44 of the tubular body. According to some implementations, the inner chamber 44 is a cooling chamber through which a coolant passes when the electrode is in operation. As best seen in FIG. 2, the diameter D5 of the through opening 42 is greater than the diameter D2 of the cylindrical body portion 31 of the emitter holder 30. The length L5 of the through opening 42 may be greater than, equal to, or less than the length L2 of the cylindrical body portion 31 of the emitter 30. In the implementation of FIG. 2, the cylindrical body portion 31 of the emitter 30 has a length that is greater than the length of the through opening 42.

FIG. 2 shows an arrangement of the emitter 20, emitter holder 30 and tubular part 40 in a pre-assembled state just prior to forces F1 and F2 being applied to the parts to secure them together with the emitter 20 being centered inside the cavity 34 of the emitter holder 30 and with the cylindrical body portion 31 of the emitter holder 30 centered inside the through opening 42 of the tubular body 40. According to some implementations, in the pre-assembled state of FIG. 2, the emitter 20 and internal cavity 34 of the emitter holder 30 are dimensioned such that a gap G1 of 0.0005 inches to 0.001 inches exist between the outer cylindrical wall 23 of the emitter and the internal wall 33 of the cavity 34, and such that the distal end 21 of the emitter 20 is located distal to the distal end 31 of the emitter holder by a distance d1 of 0.015 inches to 0.100 inches.

According to some implementations, in the pre-assembled state the cylindrical portion 31 of the emitter holder 30 and the through opening 42 of the tubular body 40 are dimensioned such that a gap G2 of 0.0005 inches to 0.001 inches exist between the outer cylindrical wall 34 of the emitter holder and the internal wall 43 of the through opening 42, and such that the distal end 31 of the emitter holder 30 is located distal to the distal end 41 of the tubular body by a distance d2 of 0.0001 inches to 0.02 inches.

Figure 3:
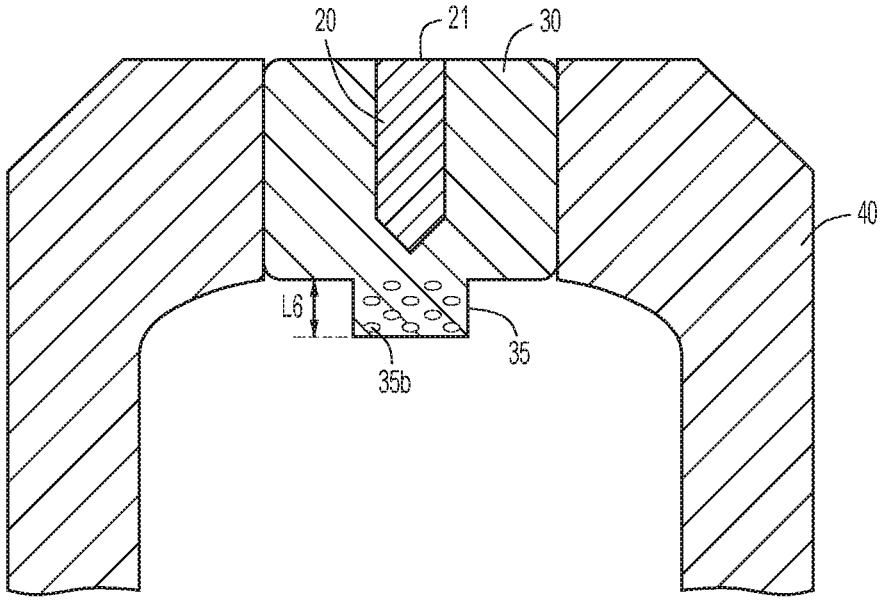
FIG. 3 is a cross-section side view of the emitter, emitter holder and tubular body according to one implementation with the emitter secured inside the emitter holder and the emitter holder secured inside the tubular body.
Figure 4:
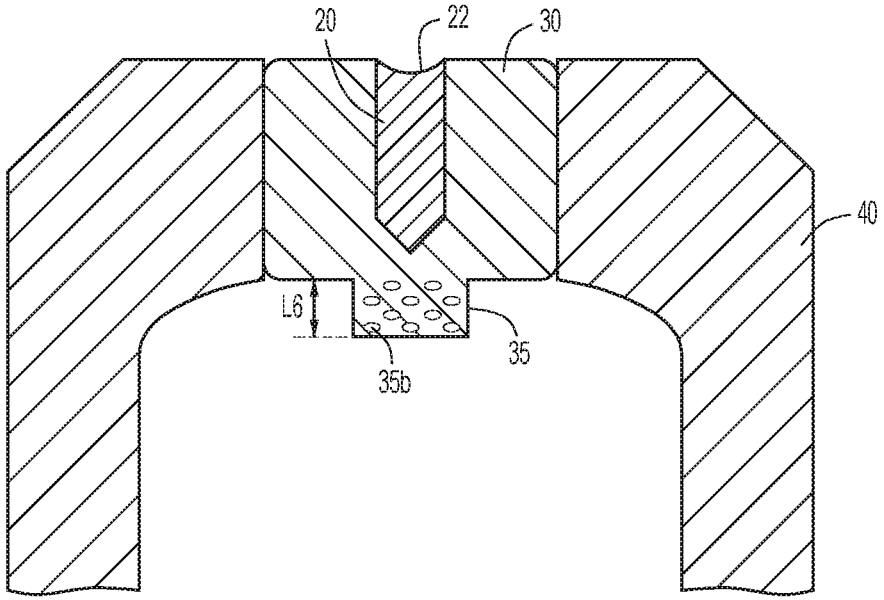
FIG. 4 is a cross-section side view of the emitter, emitter holder and tubular body according to another implementation with the emitter secured inside the emitter holder and the emitter holder secured inside the tubular body.

With the emitter 20, emitter holder 30 and tubular body 40 arranged in their pre-assembled states as shown in FIG. 2, proximal and distal directed forces F1 and F2 are applied to secure the parts together by use of tools 50 and 60. Tool 50 includes a head 51 with a proximal face 53 that is configured to press against the distal end 21 of the emitter 20 when the tool 50 is moved in the proximal direction as shown by arrow 52. Tool 60 includes a head 61 with a distal facing surface 63 that is configured to press against the proximal end 35*a* of the emitter holder 30 when the tool is moved in the distal direction as shown by arrow 62. A salient feature of the method of assembling the electrode is the simultaneous securing of the emitter 20 to the emitter holder 30 and the emitter holder 30 to the tubular body 40 by simultaneously applying force F1 to the distal end 21 of the emitter 20 and a force F2 to the proximal end 35*a* of the emitter holder 30. As shown in FIG. 3, the simultaneous application of the proximal and distal directed forces F1 and F2 causes a deformation of each of the emitter 20 and the emitter holder 30 so that the external wall 23 of the emitter 20 bulges radially outward to forcefully contact the internal wall 33 of the internal cavity 34 of the emitter holder 30, and so that the external wall 34 of the cylindrical body portion 31 of the emitter holder 30 bulges radially outward to forcefully contact the inner wall 43 of the through opening 42 of the tubular body 40. The bulging of the emitter 20 inside the cavity 34 of the emitter holder 30 permanently fixes the emitter to the emitter holder, and the bulging of the emitter holder 30 inside the through opening 42 of the tubular body 40 permanently fixes the emitter holder to the tubular body in a manner that produces a leak-tight seal and an electrical connection between the emitter holder and the tubular body. FIGS. 3 and 4 show the electrode in an assembled state according to different implementations.

According to some implementations, the heads 51 and 61 of tools 50 and 60 are cylindrical in form and have diameters D6 and D7 that are each less than the diameter D5 of the through opening 42 extending through the distal end section of the tubular body 40. According to some implementations, the first and second heads 51 and 61 have different diameters. According to some implementations, the second head 61 has a diameter that is less than the diameter of the first head 51. It is important to note that the geometric form of heads 51 and 61 need not be cylindrical, but in any event, according to some implementations the heads 51 and 61 are sized not to contact the tubular body 40 during the application of proximal and distal directed forces F1 and F2.

According to some implementations, the distance d2 and the load applied by forces F1 and F2 are selected such that distal end 31 of the emitter holder 30 is flush with or located distal to the distal end 41 of the tubular body by a distance less than d2 at the end of the application of forces F1 and F2. Even in the event of the distal end 31 of the emitter holder 30 being made flush with the distal end 41 of the tubular body 40 while forces F1 and F2 are being applied, after the forces F1 and F2 are removed, the distal end 31 of the emitter holder 30 may still thereafter distally protrude out of the through opening 42 of the tubular body 40 by a distance less than d2 due to the elasticity of the material from which the emitter holder is made.

Figure 5:
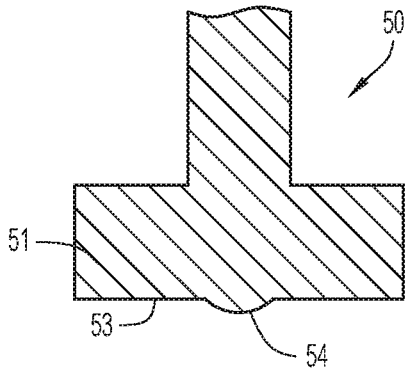
FIG. 5 is a side view of a force applicator comprising a curved protrusion for forming a concave indentation in the distal surface of the emitter of FIG. 4.

According to some implementations, the distance d1 and the load applied by forces F1 and F2 are selected such that the distal end 21 of the emitter 20 is flush with or located distal to the distal end 31 of the emitter holder 31 by a distance less than d1 at the end of the application of forces F1 and F2, as shown in FIG. 3. In such cases, the proximal facing surface 53 of the first tool 50 may be planar, as shown in FIG. 2. However, according to other implementations the distal end 21 of the emitter 20 is made to include a concave indentation 22 as shown in FIG. 4 when the forces F1 and F2 are being applied. According to some implementations, the concave indentation has a maximum depth of between 0.047 inches to 0.075 inches and is made by a curved protrusion 54 of the proximal facing surface 53 of the first tool 50 like that shown in FIG. 5.

As discussed above, according to some implementations the emitter holder 30 is equipped with a proximally protruding part 35. As shown in FIGS. 3 and 4, in the electrode's assembled state the proximally protruding part 35 resides inside a cavity/chamber 44 of the tubular body 40. In some instances, as noted above, the cavity may be a cooling chamber through which a coolant is passed to cool the emitter holder 31 when the electrode is operated. In such instances, the protruding part 35 provides addition surface area over which the coolant passes to increase the heat removal capacity of the cooling system. To further increase the heat removal capacity, as shown in FIGS. 2-4, the external surfaces of the protruding part 35 may be ribbed, dimpled, etc. to further increase the external surface area of the protruding part. FIGS. 2-4 show dimples 37.

The proximally protruding part 35 of the emitter holder 30, alternatively or in conjunction with its heat removal function, may simply act as a spacer that prevents any portion of the tool 60 from making contact with the tubular body 40 when the distal directed force F2 is being applied to the emitter holder 30.

According to some implementations, the proximally protruding part 35 is made to be shortened during the electrode assembling process as shown in FIGS. 3 and 4 as compared to FIG. 2, with the length of the protruding part transitioning from an initial length L3 to a final length L6 during the assembling process.

According to some implementations, after the electrode is in its assembled state, like that shown in FIGS. 3 and 4, a pressurized fluid is delivered into the cavity 44 of the tubular body 40 to determine the integrity of the leak-tight seal. The pressurized fluid may be, for example, air or water.

Figure 6:
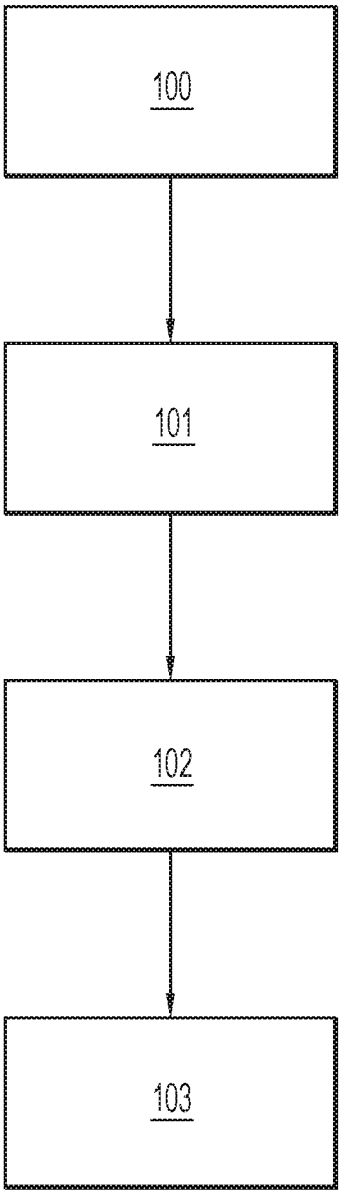
FIG. 6 is a flow diagram of a method of assembling together the parts of a plasma torch electrode according to one implementation.

FIG. 6 is a flow diagram of a method of assembling together the parts of a plasma torch electrode according to one implementation. The method includes in step 100 the obtaining of an emitter, an emitter holder and a tubular body that is to be assembled together to form the electrode. In step 101 the emitter is placed inside a cavity of the emitter holder and the emitter holder is placed inside a through opening of the tubular body. As a result of their geometric configurations, a distal end of portion of the emitter protrudes distally out of the emitter cavity and a distal end portion of the emitter holder protrudes distally out of the through opening of the tubular body. At step 102, the emitter is secured inside the cavity of the emitter holder simultaneous with the emitter holder being secured inside the distal end section of the tubular body. The securing together is accomplished by simultaneously applying a proximal directed force to the emitter and a distal directed force to the emitter holder to induce a bulging of the emitter inside the emitter holder to cause an external surface of the emitter to forcefully contact an internal surface of the emitter holder, and to induce a bulging of the emitter holder inside the distal end of the tubular body to cause an external surface of the emitter holder to forcefully contact an internal surface of the tubular body to produce a leak-tight seal and an electrical connection between the emitter holder and the tubular body. In step 103, a pressurized fluid is optionally introduced into the cavity of the tubular body for the purpose of determining the integrity of the leak-tight seal established between the emitter holder and tubular body in step 102.

The following clauses represent, in some instance, additional implementations.

Clause 1: A method of securing together a tubular body, an emitter holder and an emitter to form an electrode, each of the emitter holder and emitter having a cylindrical body portion, the tubular body, emitter and emitter holder being respectively made of first, second and third materials that are different from one another, the securing together being accomplished without soldering or fusing the emitter holder to the tubular body and without soldering or fusing the emitter to the emitter holder, the method comprising:

positioning the cylindrical body portion of the emitter in a cylindrical portion of a cavity located in the emitter holder, the emitter having a first length and the cylindrical body portion of the emitter having a first diameter, the cavity having a second length and the cylindrical portion of the cavity having an internal wall and a second diameter, the second length being less the first length, the second diameter being greater than the first diameter;

positioning the cylindrical body portion of the emitter holder inside a cylindrical through hole located at a distal end of the tubular body, the emitter holder having a third length and the cylindrical body portion of the emitter holder having a third diameter, the cylindrical through hole having a fourth diameter that is greater than the third diameter and a fourth length that is less than the third length; and simultaneously securing the emitter to the emitter holder and the emitter holder to the tubular body by simultaneously applying a first force to a distal face of the emitter and a second force opposite the first force to a proximal face of the emitter holder to cause an external surface of the cylindrical body portion of the emitter to bulge radially outward to forcefully contact the internal wall of the cylindrical cavity of the emitter holder and to cause an external surface of the cylindrical body of the emitter holder to bulge radially outward to forcefully contact a wall of the tubular body that defines the cylindrical through hole to produce a leak-tight seal and an electrical connection between the emitter holder and the wall of the tubular body.

Clause 2: The method according to clause 1, wherein each of the emitter and emitter holder shorten during the application of the first and second forces.

Clause 3: The method according to clause 1, wherein the cavity of the emitter holder has a closed proximal end.

Clause 4: The method according to clause 1, wherein a proximal end portion of the cavity of the emitter holder includes a wall that converges radially inward.

Clause 5: The method according to clause 1, wherein prior to the application of the first and second forces, a distal end of the emitter is located distal to a distal face of the emitter holder by 0.015 inches to 0.10 inches and the fourth diameter is 0.0001 inches to 0.0002 inches greater than the third diameter.

Clause 6: The method according to clause 1, wherein after the application of the first and second forces the distal end of the emitter protrudes from a distal face of the emitter holder by 0.0005 inches to 0.015 inches.

Clause 7: The method according to clause 1, wherein the emitter holder includes a part that proximally protrudes from the cylindrical body portion, the part having a first length before the application of the first and second forces and a second length after the application of the first and second forces, the second length of the part being less than the first length of the part.

Clause 8: The method according to clause 7, wherein the part resides inside a cavity of the tubular body both before and after the application of the first and second forces.

Clause 9: The method according to clause 1, wherein the first force is applied by a proximal facing surface of a first tool and the second force is applied by a distal facing surface of a second tool, each of the proximal and distal facing surfaces having a diameter that is less than the fourth diameter.

Clause 10: The method according to clause 9, wherein the proximal and distal facing surfaces have different diameters.

Clause 11: The method according to clause 9, where each of the proximal and distal facing surfaces is planar.

Clause 12: The method according to clause 9, wherein the proximal facing surfaces of the first tool is formed to produce in the distal face of the emitter a concave indentation.

Clause 13: The method according to clause 12, wherein the concave indentation has a maximum depth of between 0.047 inches to 0.075 inches.

Clause 14: The method according to clause 8, further comprising introducing a pressurized fluid into the cavity after the electrode is in its assembled state to determine integrity of the leak-tight seal.

Clause 15: The method according to clause 14, wherein the fluid is selected from the group consisting or air and water.

The particular implementations shown and described herein are illustrative examples of the invention and are not intended to otherwise limit the scope of the invention in any way. For the sake of brevity, conventional aspects of the components may not be described in detail.

What is claimed is:

1. A method of assembling an electrode comprising:

positioning an emitter of an electrode inside a cavity formed in an emitter holder of the electrode, wherein the cavity has an open distal end and a closed proximal end, the emitter has a first diameter and a first length, and the cavity has a second diameter that is greater than the first diameter and has a second length that is less than the first length;

positioning a cylindrical portion of the emitter holder within a distal through opening defined by an internal surface of a tubular body of the electrode, wherein the distal through opening has a length extending from a distal end of the tubular body to an internal cavity defined by the tubular body, and the cylindrical portion spans an entirety of the length of the distal through opening while a first part of the emitter holder protrudes proximally from the cylindrical portion into the internal cavity; and securing the emitter of the electrode inside the emitter holder while simultaneously securing the emitter holder inside the tubular body of the electrode, the securing together being accomplished by simultaneously applying a proximal directed force to the emitter and a distal directed force to the emitter holder to: (1) induce a bulging of the emitter inside the emitter holder to cause an external surface of the emitter to forcefully contact an internal surface of the emitter holder, and (2) induce a bulging of the cylindrical portion of the emitter holder inside the distal through opening of the tubular body to cause an external surface of the cylindrical portion of the emitter holder to forcefully contact the internal surface of the tubular body to produce a leak-tight seal and an electrical connection between the emitter holder and the tubular body, wherein the securing together is accomplished without soldering or fusing the emitter holder to the tubular body and without soldering or fusing the emitter to the emitter holder, and wherein part of the emitter holder has a first length before application of the proximal and distal directed forces and a second length after the application of the proximal and distal directed forces, the second length of the first part being less than the first length of the first part.

2. The method of assembling an electrode according to claim 1, wherein each of the emitter and the emitter holder shortens during the application of the proximal and distal directed forces.

3. The method of assembling an electrode according to claim 1, wherein after the application of the proximal and distal directed forces the emitter has a compressed length less than the first length of the emitter.

4. The method of assembling an electrode according to claim 3, wherein the compressed length is less than or equal to the second length of the cavity of the emitter holder.

5. The method of assembling an electrode according to claim 3, wherein the compressed length is greater than or equal to the second length of the cavity of the emitter holder.

6. The method of assembling an electrode according to claim 5, wherein after the application of the proximal and distal directed forces, the distal end portion of the emitter is located distal to a distal face of the emitter holder by 0.0005 inches to 0.015 inches.

7. The method of assembling an electrode according to claim 1, wherein prior to the application of the proximal and distal directed forces, the emitter has a distal end portion that is located distal a distal face of the emitter holder by 0.015 inches to 0.10 inches and the second diameter is 0.0001 inches to 0.0002 inches greater than the first diameter.

8. The method of assembling an electrode according to claim 1, wherein prior to the application of the proximal and distal directed forces the cylindrical portion of the emitter holder has a third diameter and a third length and the distal through opening of the tubular body has a fourth diameter greater than the third diameter, and after the application of the proximal and distal directed forces the cylindrical portion of the emitter holder has a compressed length less than the third length.

9. The method of assembling an electrode according to claim 1, wherein the cavity has a proximal end portion that includes a wall that converges radially inward.

10. The method of assembling an electrode according to claim 1, wherein, both before and after the application of the proximal and distal directed forces, the first part resides inside a cavity of the tubular body and is comprised of an equal amount of material.

11. The method of assembling an electrode according to claim 10, further comprising introducing a pressurized fluid into the cavity of the tubular body after the application of the proximal and distal directed forces to determine an integrity of the leak-tight seal.

12. The method of assembling an electrode according to claim 1, wherein the proximal directed force is applied by a proximal facing surface of a first tool and the distal directed force is applied by a distal facing surface of a second tool, each of the proximal and distal facing surfaces having a diameter that is less than a maximum diameter of the emitter holder.

13. The method of assembling an electrode according to claim 12, where each of the proximal and distal facing surfaces is planar.

14. The method of assembling an electrode according to claim 12, wherein the proximal facing surfaces of the first tool is configured to form a concave indentation in a distal face of the emitter.

15. The method of assembling an electrode according to claim 14, wherein the concave indentation has a maximum depth of between 0.047 inches to 0.075 inches.

16. The method of assembling an electrode according to claim 12, wherein the first tool comprises a first head that includes the proximal facing surface, and the second tool comprises a second head that includes the distal facing surface, the first head having a first diameter and the second head having a second diameter that is less than the first diameter.

* * * * *